US005636733A

United States Patent [19]

Marchwiak

[11] Patent Number: 5,636,733

[45] Date of Patent: Jun. 10, 1997

[54] LUGGAGE WITH RETRACTABLE HOOK

[75] Inventor: Zbigniew Marchwiak, Chicago, Ill.

[73] Assignee: Travel Caddy, Inc., Chicago, Ill.

[21] Appl. No.: 524,299

[22] Filed: Sep. 6, 1995

[51] Int. Cl.[6] ..... A45C 5/12

[52] U.S. Cl. ..... 206/287.1; 190/18 A; 206/284

[58] Field of Search ..... 190/18 A, 18 R, 190/115; 206/284, 286, 287, 287.1, 289; 24/647, 650

[56] References Cited

U.S. PATENT DOCUMENTS

| | | | |
|---|---|---|---|
| 4,887,700 | 12/1989 | Rice | 206/287.1 X |
| 4,924,562 | 5/1990 | Poghanian | 24/647 |
| 5,064,061 | 11/1991 | Moxley | 206/289 |
| 5,136,858 | 8/1992 | Bruner | 24/650 X |
| 5,167,306 | 12/1992 | Carrigan, Jr. | 190/115 X |
| 5,303,805 | 4/1994 | Hauser | 190/18 A |
| 5,375,685 | 12/1994 | Plath | 190/18 A |
| 5,505,297 | 4/1996 | Myers | 206/287.1 X |
| 5,533,600 | 7/1996 | Van Himbeeck et al. | 190/18 R |

OTHER PUBLICATIONS

"Built For Life Outside of Airports." 1 page ad for Boyt Glider™ Luggage System (Booth #441), The Boyt Company, Iowa Falls, IA; Showcase, Washington, D.C. Pre-Show Issue, Nov./Dec. 1994.

"Introducing the Ciao! Go Cart Travel System™*. The most versatile system. Ever.," 1 page ad (Booths #1156/1256), Lifestyle International, Inc., Secaucus, NJ; Showcase, Washington, D.C. Pre-Show Issue, Nov./Dec. 1994.

"New Mark II from Clipper-Jet Set," 1/2 page ad (Booth #417), Clipper Products, Cincinnati, Ohio; Showcase, Washington, D.C. Pre-Show Issue, Nov./Dec. 1994.

"Clipper's new carts with safety features and telescoping releases," article, Item #1 on page 65, Showcase, Nov./Dec. 1994.

"American Flyer Introduces The G5 Extender," 1/2 page ad (Booth #1454), Item #2 on page 65, Showcase, Nov./Dec. 1994.

"What's my line?," one-page ad (Booth #302A), Skyway USA, Showcase, Washington, D.C. Pre-Show Issue, Nov./Dec. 1994.

*Primary Examiner*—Allan N. Shoap
*Assistant Examiner*—Christopher J. McDonald
*Attorney, Agent, or Firm*—Fitch, Even, Tabin & Flannery

[57] ABSTRACT

A garment bag includes a flexible body defining an enclosed interior. A connecting strap is disposed within the interior, and is connected to the bag body at a lower end. The upper end of the connecting strap is free to move, and is attached to a hook. The upper end of the garment bag includes a rigid plate defining an aperture to which the strap passes. The connecting strap, or a portion thereof, is resiliently stretchable for hanging the bag, and so as to retract the hook when released from the hanging position.

25 Claims, 18 Drawing Sheets

LUGGAGE WITH RETRACTABLE HOOK

BACKGROUND OF THE INVENTION

1. Field of the Invention

The present invention pertains to luggage adapted for hanging support, and in particular to garment bags.

2. Description of the Related Art

With increasingly busy schedules, travellers are continually seeking improvements in luggage, especially luggage of the type personally carried by the traveler. One type of such luggage in popular use today is commonly referred to as a garment bag. This type of luggage is typically soft-sided or flexible and is vertically elongated to accommodate a full length garment, such as a dress or full length coat. The garment bag is folded in half for carrying, such that both top and bottom ends are made to point downwardly, and a handle installed in the middle of the bag is pointed in an upward direction for carrying. The garment bag is loaded and unloaded by unfolding the bag to its vertically elongated configuration.

A hook is provided at the top end of the bag, typically connected to the bag by a chain or other flexible member. The hook is adapted to engage a clothes rack, the top of an interior door or other conventional supporting structure that a traveler might find in a hotel room, for example. Garments and other articles are then inserted within the garment bag, and are typically hung inside the bag, from its top end. The garment bag is then closed, as with a zipper, and folded in half, thereby made ready for travel. However, the top end of the garment bag, and hence the hook-type hanger, is pointed downward, close to the ground as a traveler walks from place to place. There is the likelihood that a dangling hook may become unintentionally engaged with an article in the surrounding environment. While it is desirable that such inconvenient occurrences be avoided, the hook-type hanger has proven to be very popular for loading and unloading the garment bag.

SUMMARY OF THE INVENTION

It is an object of the present invention to provide an item of luggage adapted to be hung from a hook located at its upper end.

Another object of the present invention is to provide an item of luggage of the above-described type in which the hook is at least partly retracted when not required, thus eliminating unintentional engagement with items in the surrounding environment.

A further object according to principles of the present invention is to provide an automatically retractable hook of the type described above.

Yet another object of the present invention is to provide a garment bag having the automatic retracting features mentioned above.

A further object of the present invention is to provide a latching system for a garment bag, and especially one which cooperates with a retractable hook for hanging the garment bag.

These and other objects according to principles of the present invention are provided in an improved hand-carried baggage article, comprising a flexible, vertically elongated bag defining an enclosed interior and having opposed top and bottom ends, and foldable about a midsection which is located between the top and bottom ends so as to form two at least partly overlying half portions. The elongated bag has a top plate attached to the top end of the bag and defining an aperture communicating with the bag interior, a hook means for hanging support of the bag, and a flexible elongated connecting member. The connecting member has a first, free end and a second end. The first end is connected to the hook means and the second end coupled to a portion of the bag located remote from the bag top end. The connecting member also has biasing means for resiliently biasing at least the first end of the connecting member toward the second end of the connecting member, the connecting member extending through the top plate aperture and cooperating with the biasing means to allow the hook means to move between extended and retracted positions with at least a portion of the hook means extending beyond the top plate when the hook means is in an extended position, and with the hook means seated against the top plate when the hook means is in the retracted position.

Other objects of the present invention are provided in an improved hand-carried baggage article, comprising a flexible, vertically elongated bag defining an enclosed interior and having opposed top and bottom ends, and foldable about a midsection which is located between the top and bottom ends so as to form two at least partly overlying half portions. The elongated bag has a top plate attached to the top end of the bag, having a mating edge and defining an aperture communicating with the bag interior. The elongated bag also has a bottom plate attached to the bottom end of the bag and a mating edge. The bag has releasable joinder means for releasably joining the mating edges of the top and bottom plates together when the bag is folded to overlie one half portion with the other. The releasable joinder means includes a latching recess extending from the mating edge of one of said top and said bottom plates, a latching finger extending from the other of said top and said bottom plates and dimensioned to be received in the latching recess, and a latch means carried on said one of said top and said bottom plates, adjacent the latching recess, for releasably engaging the finger.

Further objects of the present invention are provided in an improved hand-carried baggage article, comprising a flexible, vertically elongated bag defining an enclosed interior and having opposed top and bottom ends, and foldable about a midsection which is located between the top and bottom ends so as to form two at least partly overlying half portions. The elongated bag has a top plate attached to the top end of the bag and defining an aperture communicating with the bag interior and a hook means for hanging support of the bag. The bag has a flexible elongated connecting member having a first, free end and a second end. The first end is connected to the hook means and the second end is coupled to a portion of the bag located remote from the bag top end. It also has biasing means for resiliently biasing at least the first end of the connecting member toward the second end of the connecting member. The connecting member extends through the top plate aperture and cooperates with the biasing means to allow the hook means to move between extended and retracted positions with at least a portion of the hook means extending beyond the top plate when the hook means is in an extended position, and with the hook means seated against the top plate when the hook means is in the retracted position. The top plate includes a guide wall extending from the interior surface, the guide wall defining a trough-shaped recess for guiding the connecting member as the hook means is moved between extended and retracted positions.

BRIEF DESCRIPTION OF TEE DRAWINGS

FIG. 14 is an exploded perspective view showing the detail of the handle construction of the cart of FIG. 12.

DETAILED DESCRIPTION OF THE PREFERRED EMBODIMENTS

Figure 3:
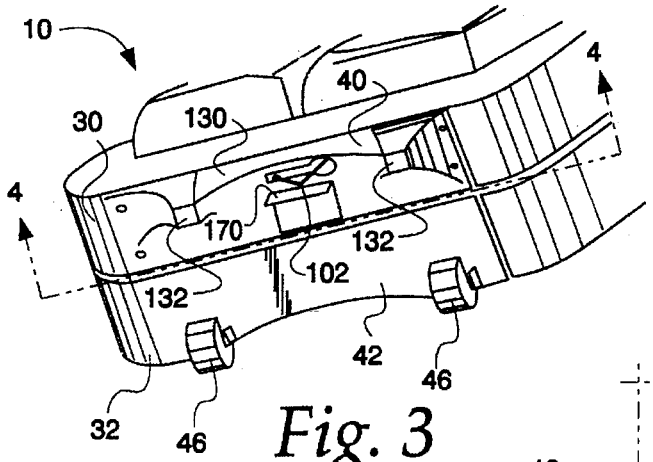
FIG. 3 is a fragmentary perspective view of the bag of FIG. 2.
Figure 1:
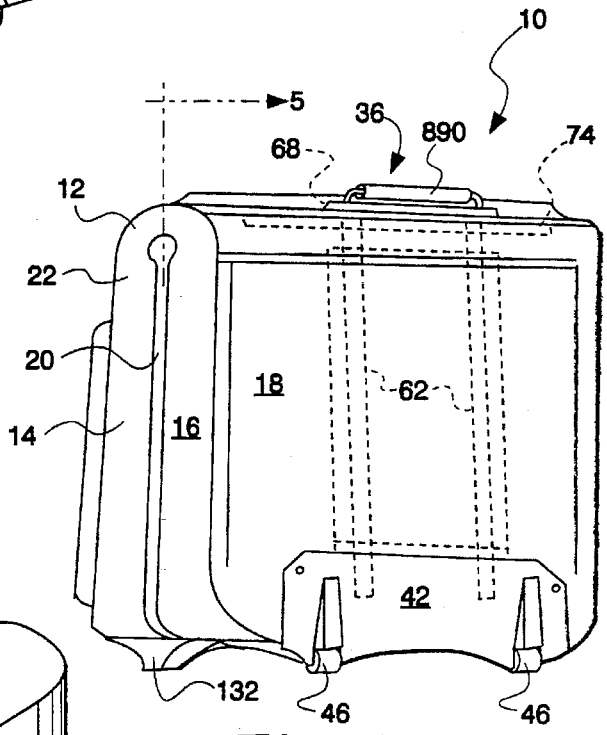
FIG. 1 is a rear perspective view of a garment bag in a folded position, made ready for transport.
Figure 2:
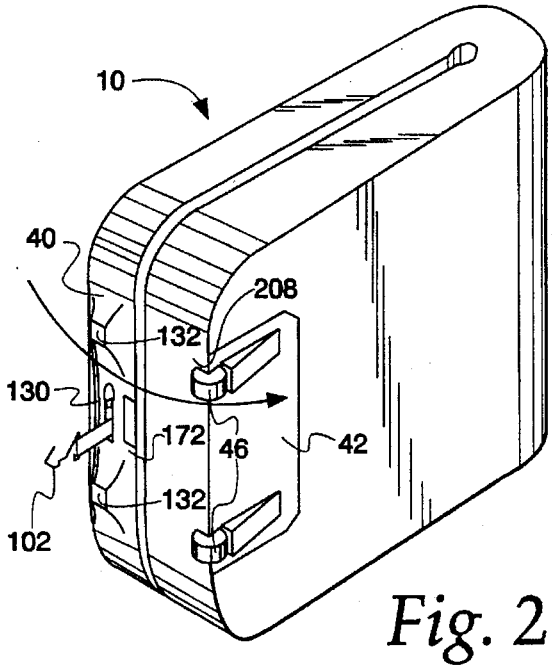
FIG. 2 is a perspective view of the garment bag of FIG. 1, shown tipped on its side.
Figure 5:
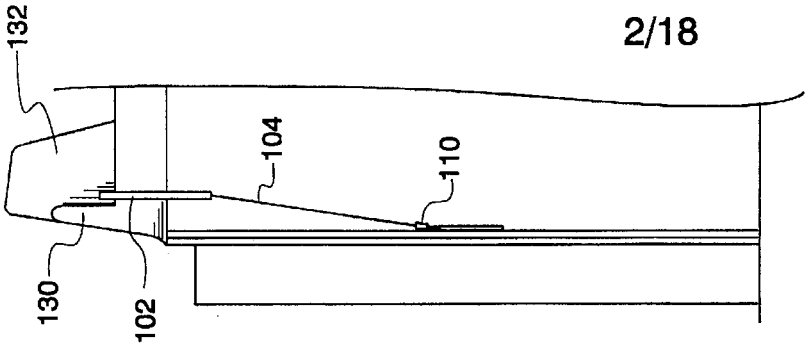
FIG. 5 is a fragmentary cross-sectional view taken along the line 5—5 of FIG. 4.
Figure 7:
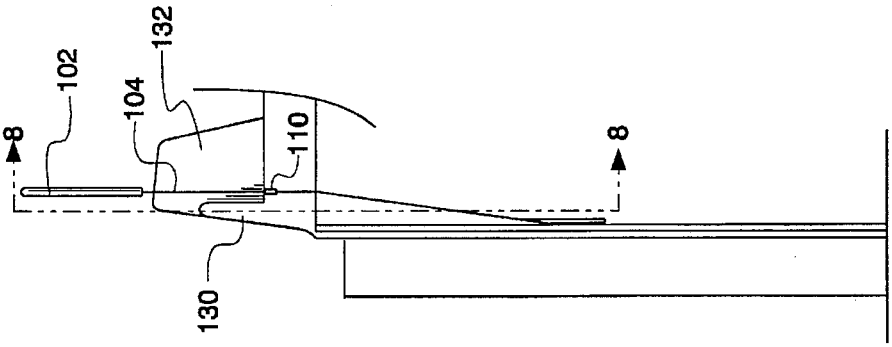
FIG. 7 is a fragmentary cross-sectional view taken along the line 7—7 of FIG. 6.

Turning now to the drawings, FIG. 1 shows a garment bag generally indicated at 10. The garment bag includes a flexible body 12, folded in half as shown in FIG. 1, so as to form overlapping half portions 14, 16. Body 12 includes opposed major walls 18, 20 and sidewalls 22 joined together so as to form an enclosed interior. Referring additionally to FIGS. 2 and 3, bag 10 (when unfolded) has a top end 30 and a bottom end 32. When folded for transport in the manner shown in FIGS. 1–3, the top and bottom ends 30, 32 are located adjacent one another, and both are downwardly facing when the bag is carried by handle 36, as shown in FIG. 1.

Figure 13:
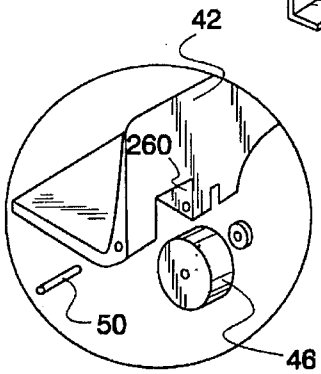
FIG. 13 is an exploded perspective view of a bottom corner of the cart of FIG. 12.

In the preferred embodiment, major wall 20 has a zipper opening extending generally from the top and to the bottom end of the bag, in a conventional manner. Top and bottom closure members 40, 42 are attached to the top and bottom ends of bag 10. As can be seen in the figures, bottom closure member 42 includes a pair of rollers 46. As shown in FIG. 13, rollers 46 are joined to closure member 42 by roller-mounting shafts 50.

Figure 14A:
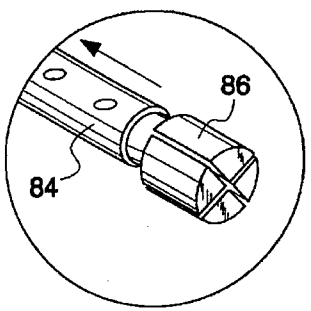
FIGS. 14*a* and 14*b* show fragmentary views of the handle of FIG. 12, on an enlarge scale.
Figure 14B:
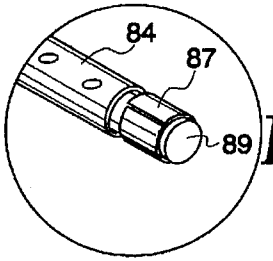
Figure 12:
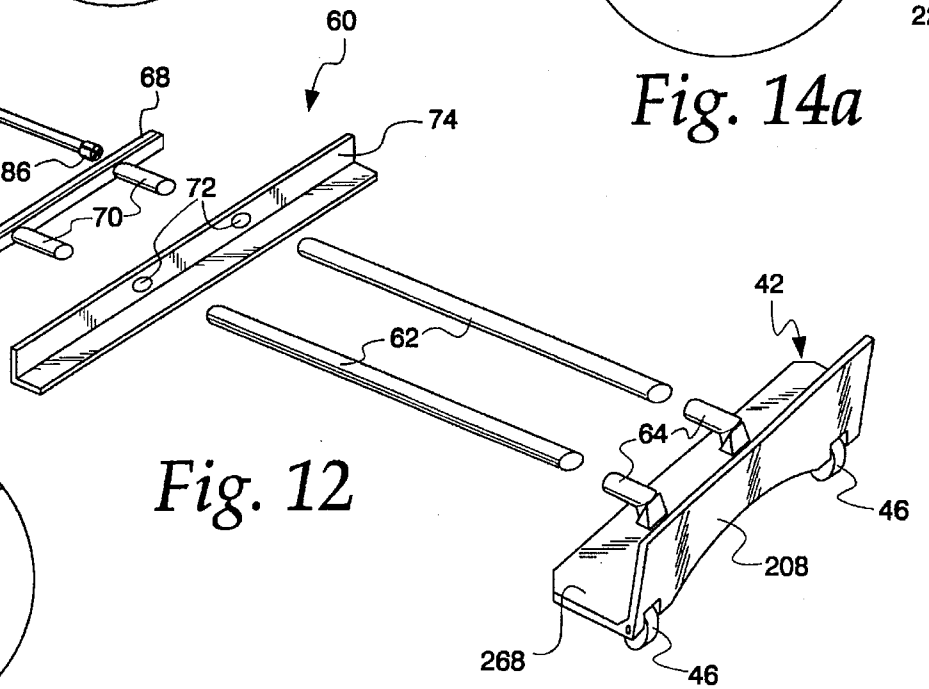
FIG. 12 is an exploded perspective view of a cart contained within the traveling bag.

With additional reference to FIGS. 12–14, bottom closure member 42 forms part of a cart assembly generally indicated at 60. In addition to the plastic bottom closure member 42, assembly 60 includes plastic support tubes 62 joined to bottom closure member 42 by telescopic interfitting with attachment members 64, formed as part of the molded part comprising bottom closure member 42. A plastic mounting member 68 includes a pair of legs 70 inserted through aperture 72 formed in an internal plastic support member 74 for telescopic interfitting with the upper ends of support tubes 62. A metallic U-shaped handle 36 includes a manually graspable bight portion 82 between legs 84 which are inserted through legs 70 of mounting member 68 so as to be received in support tubes 62. Legs 84 reciprocate back and forth within support tubes 62 and are prevented from unintentional disengagement therewith by stop members 86 attached to the free ends of legs 84 (see FIGS. 12 and 14*a*). FIG. 14*b* shows an optional stop member comprising a split collar 87 held captive by a pin having an enlarged head 89. An optional cushioning sleeve 890 is inserted over bight portion 82 of handle 36 (see FIG. 1).

Preferably, the entire cart 60 is made of plastic components, except for the handle 36 which is made of metal. All of the components of cart 60 shown in FIG. 12 are made by conventional plastic molding techniques, and if desired the handle 36 could also be made of plastic, preferably a fiber reinforced or filled plastic to reduce bending distortion. The telescopic fitting of tubes 62 to the legs 70 and bottom closure member 42 are preferably secured with a suitable plastic adhesive, and the internal support member 74 is secured to the garment bag body by stitching or a suitable adhesive. If desired, the cart 60 could be molded as a one-piece plastic unit.

Figure 4:
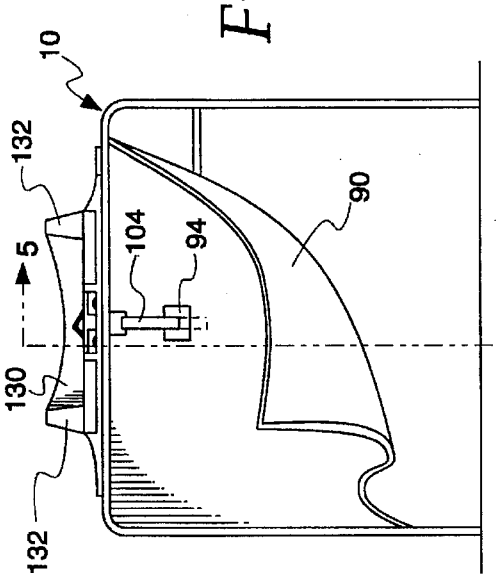
FIG. 4 is a fragmentary elevational view showing one-half of the folded garment bag.
Figure 6:
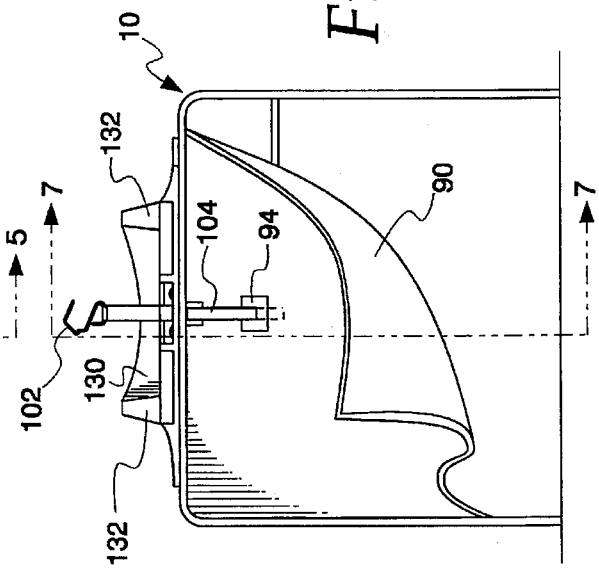
FIG. 6 is a view similar to that of FIG. 4 but showing the hook in an extended position.

Turning now to FIGS. 4–9, garment bag body 12 includes major wall 20 located at the interior of the garment bag when folded in the manner indicated in FIG. 1. In FIGS. 4 and 6, major wall 20 is peeled back to reveal the interior of the bag. A liner wall 90 is attached to the exterior major wall 18. An opening (not shown) is formed in a reinforcing patch 94 affixed to liner wall 90.

Figure 9:
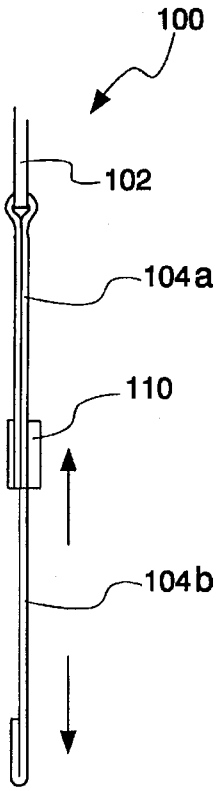
FIG. 9 is a side elevational view of the hook assembly of FIG. 8.
Figure 8:
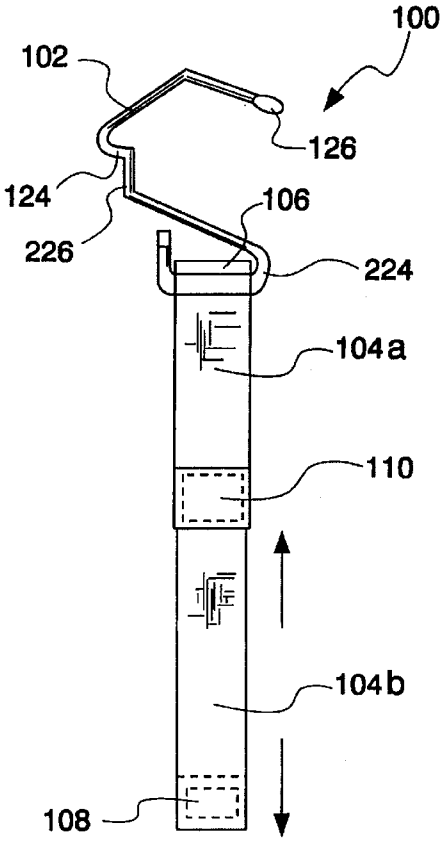
FIG. 8 is a fragmentary cross-sectional view taken along the line 8—8 of FIG. 7.

Referring additionally to FIGS. 8 and 9, a hanger assembly is generally indicated at 100 and includes a hook 102 and a flexible connecting strap 104. The connecting strap 104 includes upper and lower ends 106, 108. In the preferred embodiment, the connecting strap 104 is preferably comprised of a resilient, elastic fabric material readily available as a commercial item. Such material typically comprises a web of inelastic material which is combined by weaving or stitching with one or more strands of elastic material. The strap 104 is elongated in a generally vertical direction and has an extended length when tension is applied. This stretching of the connecting strap 104 scores resilient bias forces in the strap when tend to contract the strap, to its minimum, pre-tensioned length. In the preferred embodiment, the strap 104 is looped over hook 102 and secured by stitching to a securement tab 110, while the bottom end 108 of strap 104 is doubled over and secured by stitching, in the manner shown in FIG. 9. In the preferred embodiment, only the portion **104*b* of the strap, that portion located below securement tab 110 is stretched when tension is applied by hook 102. The upper portion 104*a* of the strap is preferably made of non-stretch material. The securement tab provides a number of functions. For example the securement tab 110 joins the dissimilar strap portions 104*a*, 104*b*** together and also interferes with the withdrawal of lower strap portions from the garment bag.

Referring to FIGS. 4–7, the bottom end 108 of strap 104 is secured between outer major wall 18 and liner wall 90, by stitching. Thus, the bottom end of strap 104 is fixed, while the upper end of strap 104 remains free for vertical travel in the manner indicated in FIGS. 2 and 7 so as to allow hook 102 to move between and extended position above closure member 40 and a retracted position seated within closure member 40, as shown, for example, in FIG. 22. In the preferred embodiment, the lower end of strap 104 is inserted through an opening in patch 94 and, if desired, may optionally be secured to the exposed surface of reinforcement patch 94 to further strengthen the joinder of the connecting strap to the bag.

Figure 10:
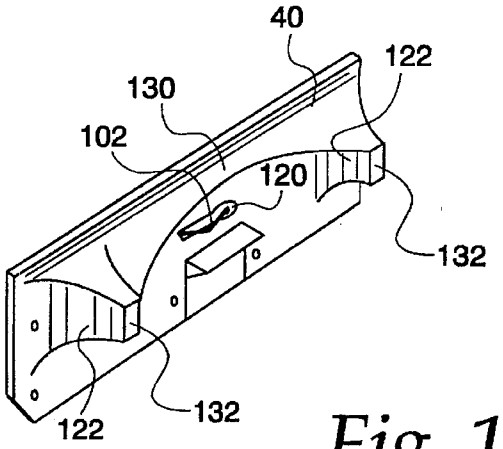
FIG. 10 is a perspective view of a top closure member which is attached to the garment bag.
Figure 11:
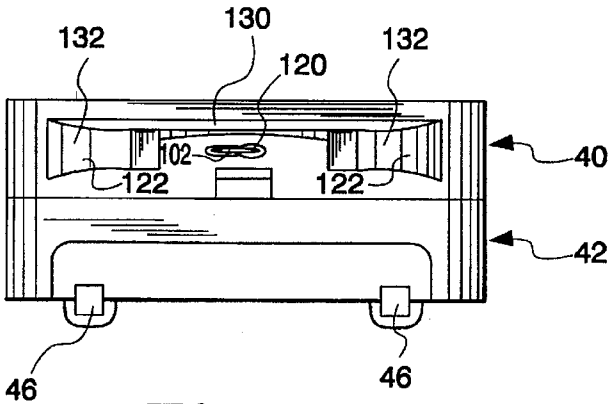
FIG. 11 is a bottom view of the folded traveling bag of FIG. 1.

Turning now to FIGS. 10 and 11, top closure member 40 defines an aperture 120, flanked on either end by shoulders 122. The upper strap portion **104*a* is passed through aperture 120 in the manner indicated in FIGS. 2, 6 and 7, for example. The strap portions are doubled over at the securement tab 110, and the increased thickness interferes with passage of the securement tab through the aperture 120, thus effectively transferring the strap loading to the top closure member. With reference to FIG. 8, hook 102 includes an offset 124 and an opposed tip 126 which are dimensioned so as to seat against top closure member 40, preventing hook 102 from being unintentionally pulled into the interior of bag 10. As shown in FIG. 4 the hook 102 is substantially entirely received within top closure member 40 except for a small portion which is graspable by a user so as to extend hook 102 above the bag in the manner shown in FIG. 6. As shown in FIG. 4, for example, a small protruding portion of hook 102 (as well as button 170) is shielded by an upstanding shielding wall 130, which spans shoulders 122. The shoulders include support feet 132 which cooperate with rollers 46 to support the folded bag 10 in an upright position when placed on a floor (see FIG. 1**).

As mentioned above, a user grasps the handle 36 to carry bag 10 from place to place, in its folded condition. Upon arrival, the user unfolds the bag, with its top end pointing up. By grasping the tip of hook 102, visible in FIG. 4, the hook is extended in an upward direction, stretching the lower part of connecting strap 104. The bag 10 may then be hung in a desired position on a door or clothes rack, for example, with the weight of the bag being borne by the engagement of the securement tab with the upper housing member. When readied for travel, bag 10 is unhooked from its support, and a substantial portion of hook 102, i.e., at least half of its height, is allowed to retract within top closure member 40, with hook portions 124, 126 resting against top closure member 40. The bag may then be folded in the manner indicated in FIG. 1.

Figure 15:
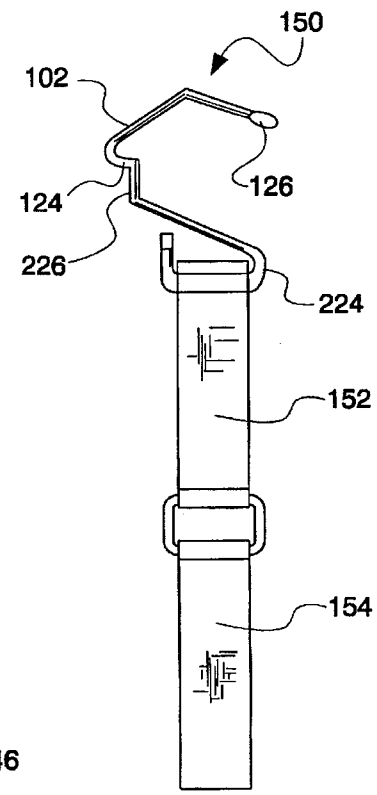
FIG. 15 is a front elevational view of an alternative hook assembly.

Turning now to FIG. 15, an alternative hanger assembly is generally indicated at 150. Hook 102 is attached to a first strap 152 which in turn is coupled to a second strap 154 to a coupling link 156. In hanger assembly 150, either strap 152 or 154, or both, may be made to be stretchably resilient. Alternatively, strap 152 could be made to be substantially nonresilient (e.g., it could be made of a canvas or other cloth or a rope) with all the resilience of the strap assembly residing in the second strap 154 which serves as a biasing means for strap 152. Spring arrangements (e.g., flat springs, or coil springs) could also be used, and the biasing means could be located to one end of the connecting strap or could be made as a composite construction therewith. Alternatively, strap 152 could be made to be resilient with strap 154 being nonresilient, and this may offer advantages in some applications. In the preferred embodiment of hanger assembly 150, link 156 is dimensioned so as to pass through the aperture 120 in top closure member 40.

Several variations are possible with the hanger assembly as described above. For example, the connecting strap can be made longer, if desired, with the bottom end being connected adjacent the midsection of the bag body. If the strap is made sufficiently flexible, the strap could extend below the midsection, if desired, with the reinforcing patch 94 cooperating with the liner wall 90 to guide the connecting strap out of contact with garments or other articles placed inside the bag. Although the lower connecting strap portion is preferably made of an inelastic fabric or fabric composite with resilient biasing means comprising elastic strands woven into or joined with the fabric, other materials can also be used. For example, the entire strap or a portion thereof (preferably the lower portion thereof) could comprise a cord made of a rubber or rubber composite material or, alternatively, a rubber material wrapped in a stretch fabric. It is generally preferred that the connecting member have an elongated cross section so as to form a strap so as to resist twisting of a garment bag about a vertical axis when hung in position. However, the entire connecting strap or portions thereof can have a different (e.g., circular or rounded) cross section.

As mentioned above, the top and bottom ends of the bag may be temporarily locked together to configure bag 10 in a doubled-over configuration (as shown for example in FIGS. 1–3) for carrying by the handle. Turning now to FIGS.

Figure 16:
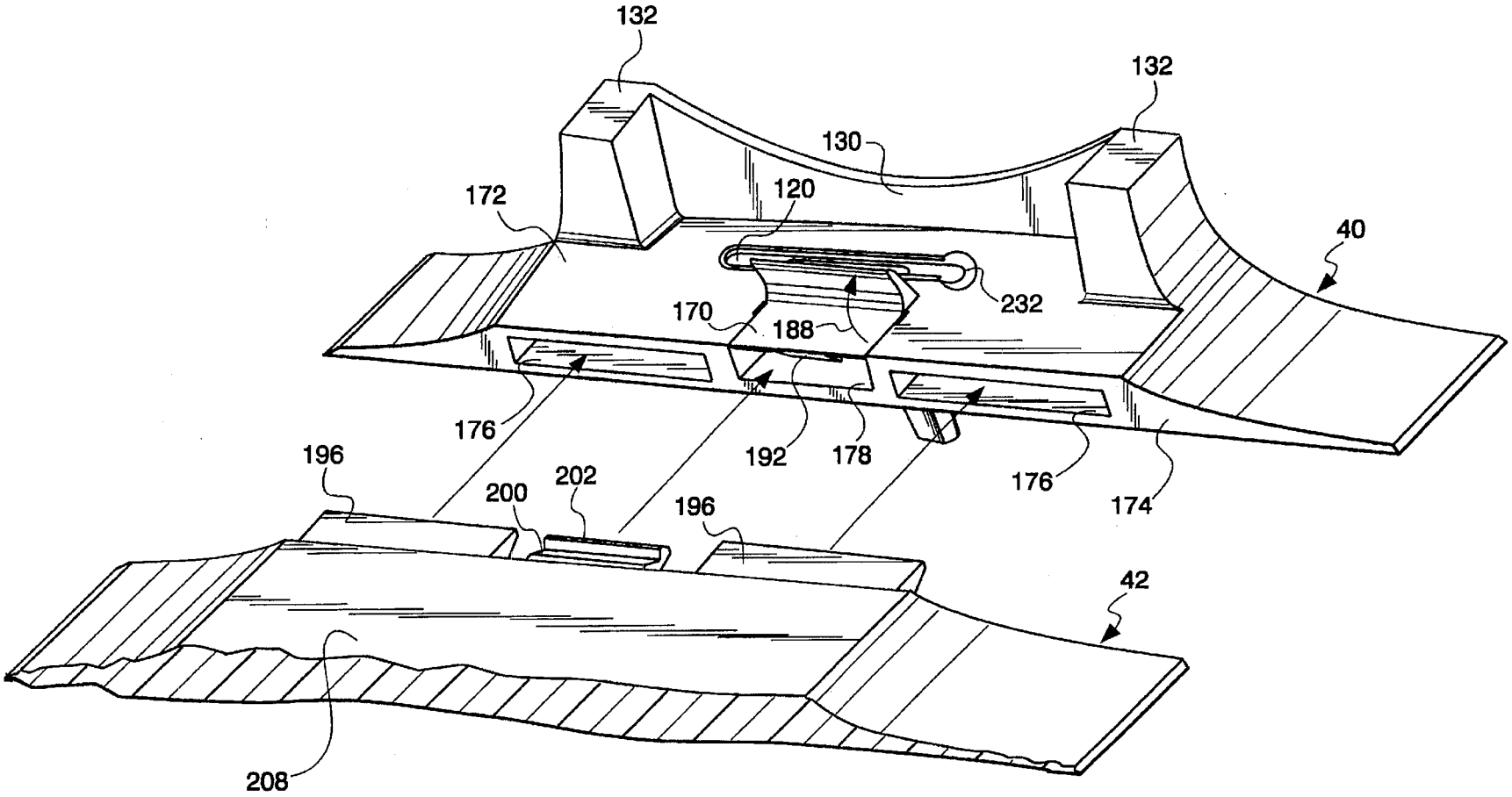
FIG. 16 is a fragmentary perspective view of the closure members of the traveling bag.
Figure 17:
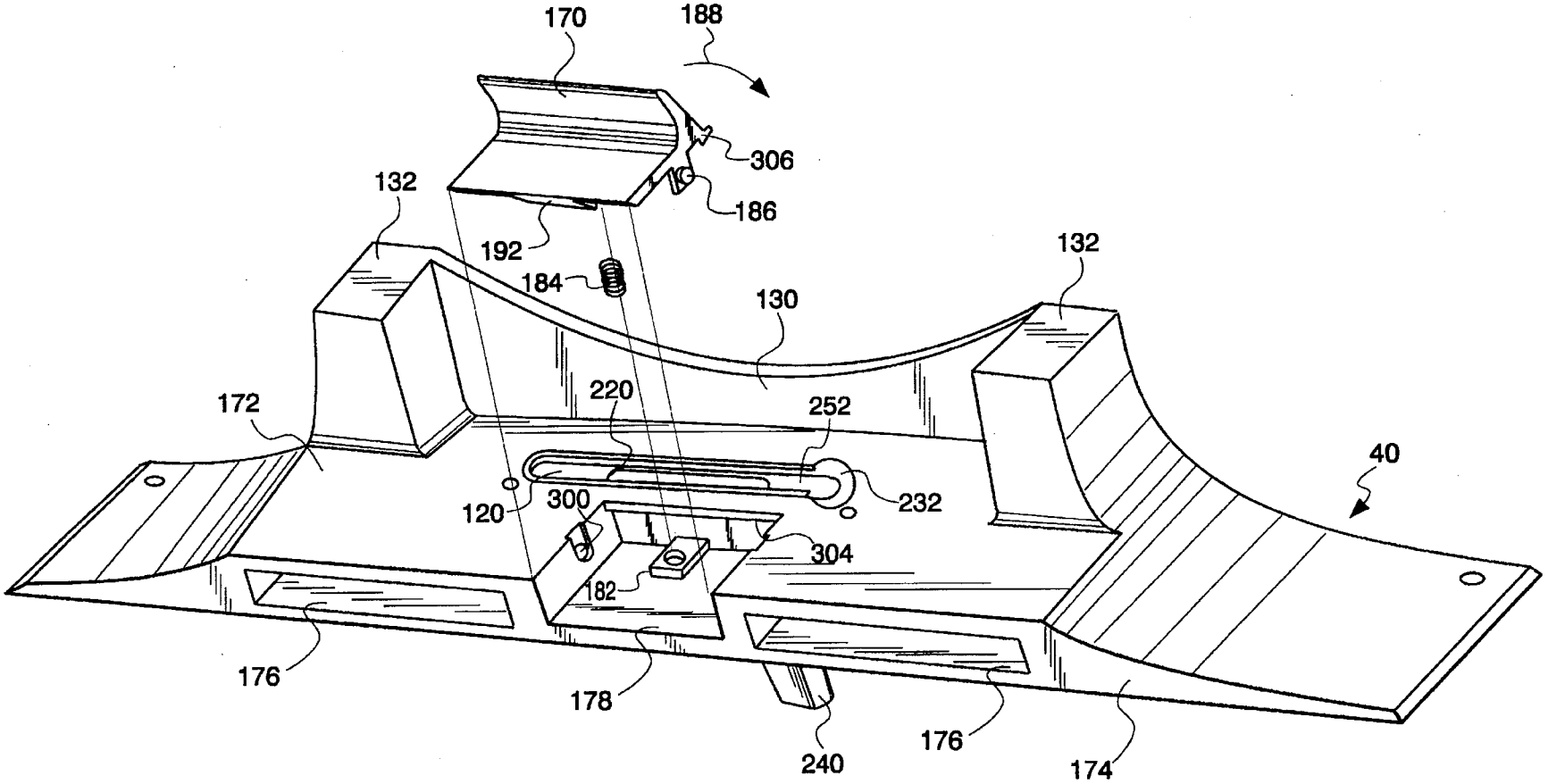
FIG. 17 is an exploded perspective view of the top closure member.

17–19, closure members 40, 42 are snap-fit together and are unlocked with operation of a button 170. As can be seen in FIG. 16, the top closure member 40 comprises a plate having an exterior face 172 in which button 170 is mounted and in which aperture 120 is formed. Closure member 40 further includes a mating edge face 174 in which a pair of guide recesses or pockets 176 and a central latching recess 178 are formed. As can be seen in FIG. 17, a raised pad 182 provides a seat for a coil spring 184 which biases button 170 for rotation about mounting pins 186 in the direction of arrow 188. Button 170 includes a latch 192 at its free end.

As can be seen in FIG. 16, bottom closure member 42 comprises a plate having a pair of guide fingers 196 which extend from a mating edge face 198 and which are receivable in the pockets 176. The pockets 176 and guide fingers 196 have rectangular cross-sectional shapes which are elongated in the same direction, being aligned along a common axis (parallel to the major surfaces of the plates) so as to align the closure members 40, 42. Closure member 42 further includes a tongue 200 having an enlarged latch engaging end 202. With additional reference to FIGS. 20 and 21, latch 192 of button 170 has a chamfered leading edge 206 which causes the button to be deflected in the direction indicated in FIG. 21 when the closure members 40, 42 are snapped together. The bottom closure member 42 has an exterior bottom surface 208 which is aligned coplanar with the exterior surface 172 of top closure member 40, as can be seen in FIG. 2.

Figure 20:
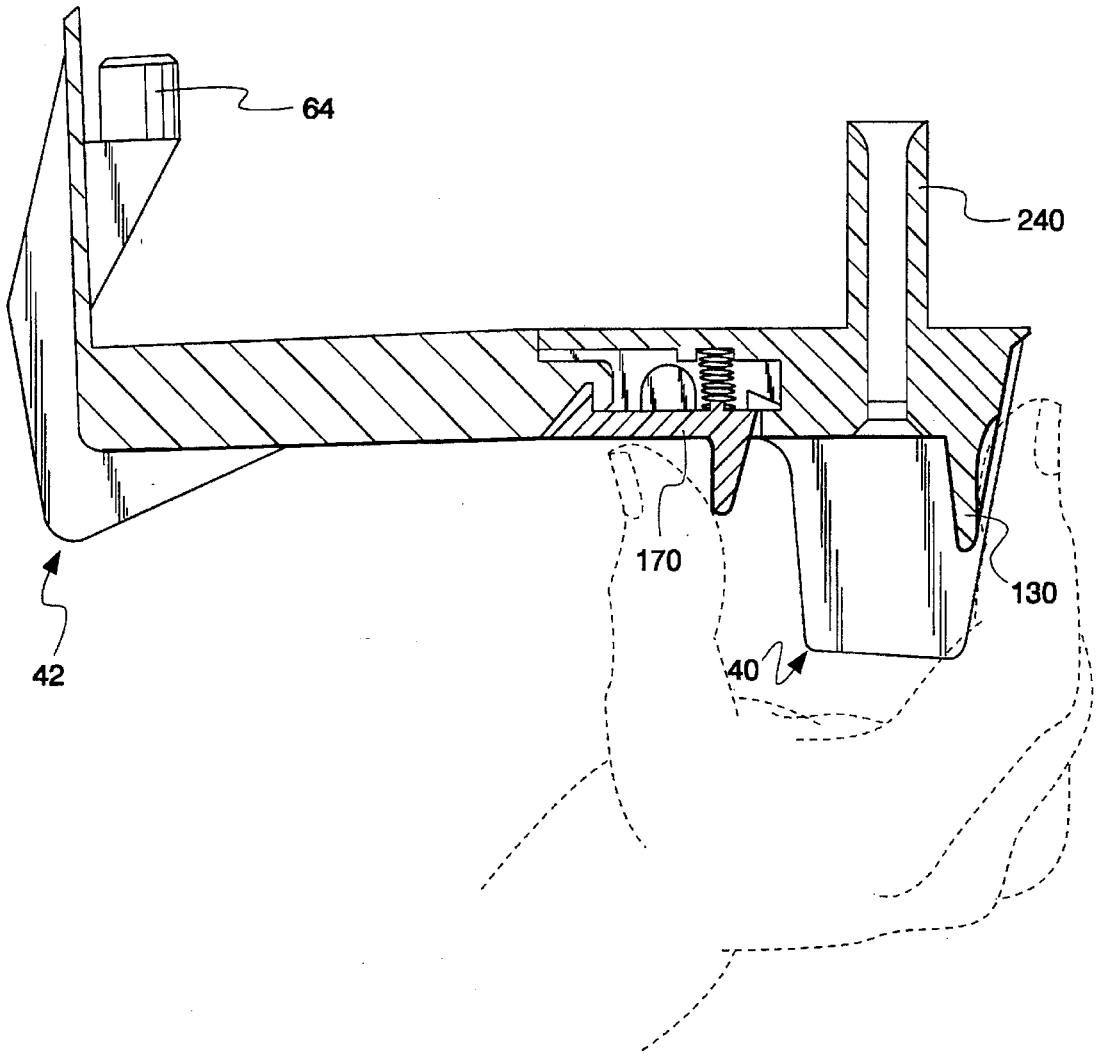
FIG. 20 is a cross-sectional view taken along the line 20—20 of FIG. 18.
Figure 21:
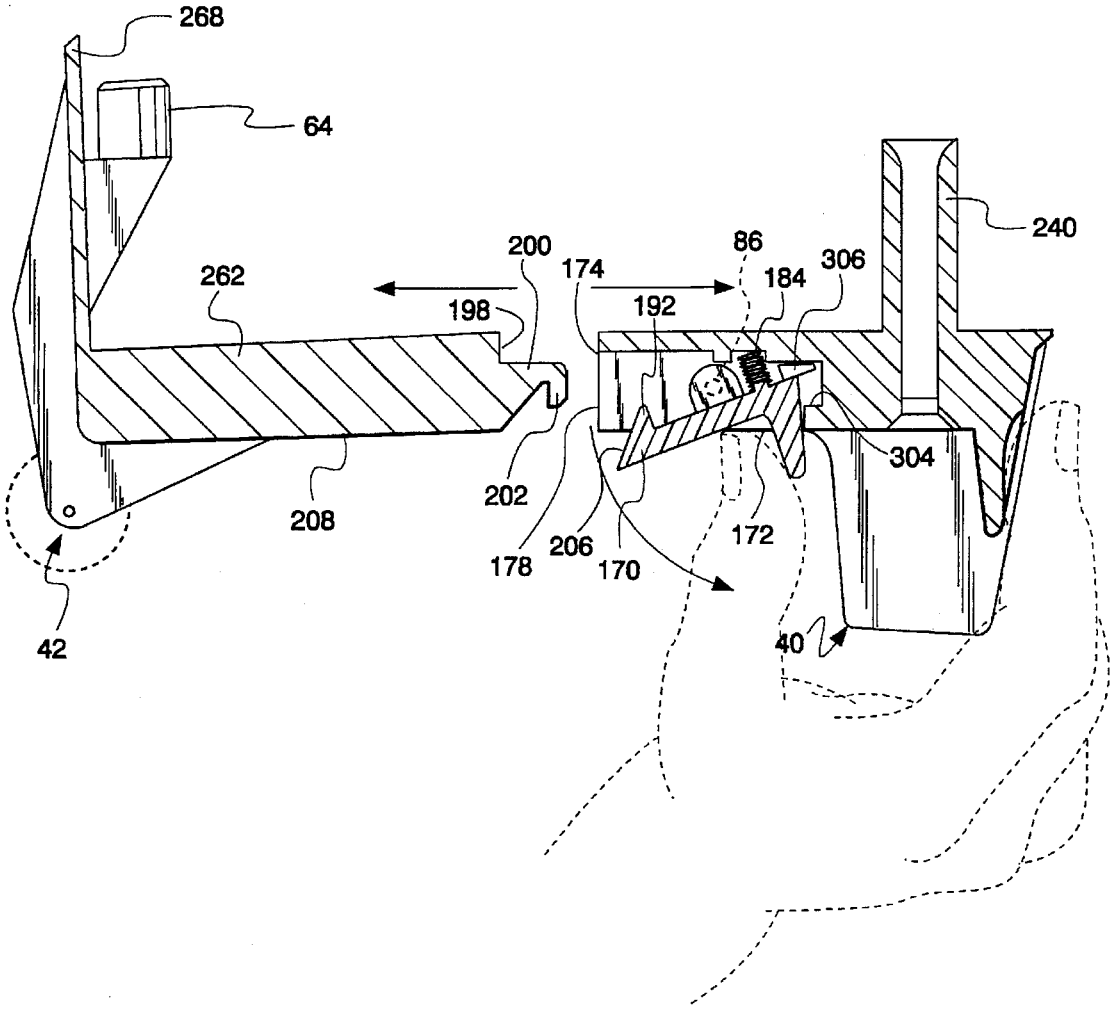
FIG. 21 is a cross-sectional view taken along the line 21—21 of FIG. 19.

FIGS. 20 and 21 show unlatching of the closure members 40, 42. As illustrated in FIG. 20, pressure is applied to button 170 causing the button to rotate in the manner indicated in FIG. 21, thereby disengaging the latch 192 of button 170 from tongue 200, allowing the closure members to be separated, to thereby open the bag 10. As a point of reference, FIGS. 20 and 21 shown the closure members in the same spatial orientation as in FIG. 1, with the bottom surfaces 172,208 facing in a downward direction. As indicated in FIG. 20, guide wall 130 can be used to develop the manual force needed to unlatch the closure members. As can be seen in FIG. 20, wall 130 effectively shields button 170 from inadvertent contact.

Figure 19:
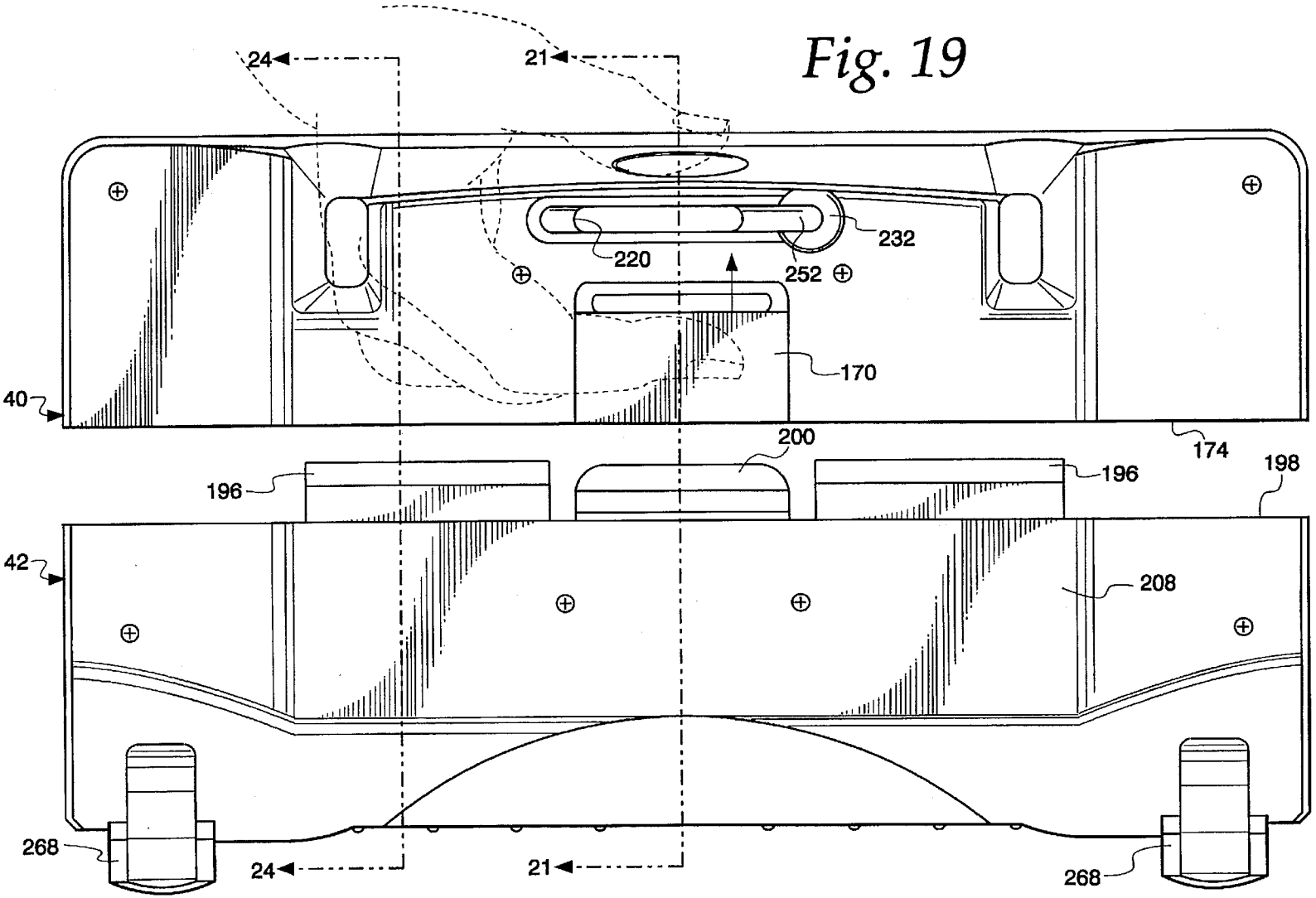
FIG. 19 shows the closure members of FIG. 18 in an open, unlatched position.

Referring again to FIG. 17, the upper closure member 40 is preferably formed as an integral molded part, with the exception of button 170 and spring 184, which are added thereto to form the completed closure member. The closure member 42, illustrated for example in FIGS. 19–21, is also preferably formed as an integral molded part. However, the closure members could be formed from additional cooperating parts, if desired.

Figure 23:
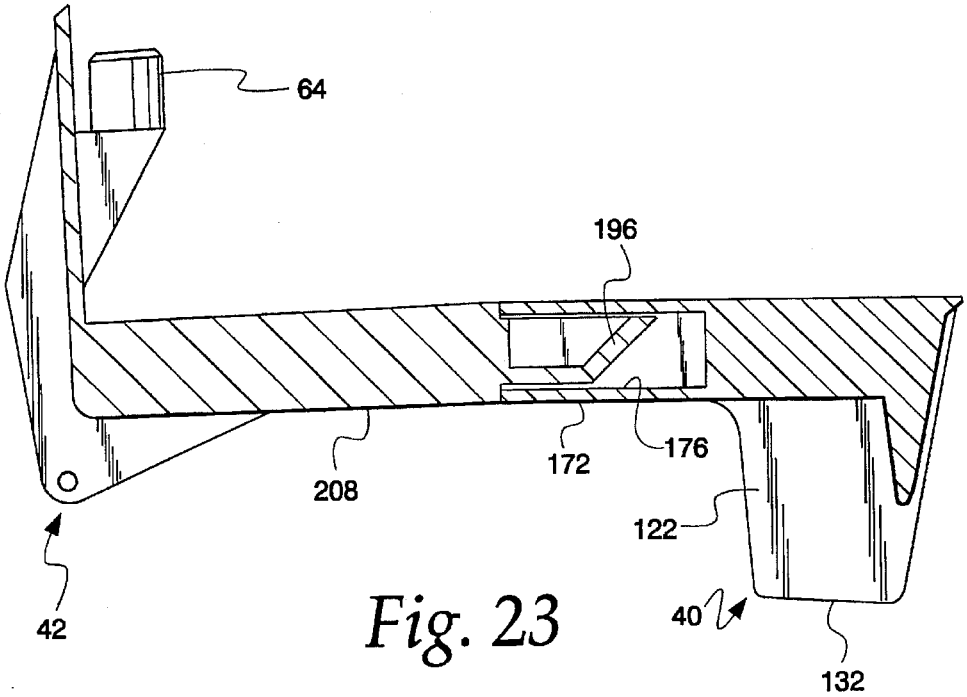
FIG. 23 is a cross-sectional view taken along the line 23—23 of FIG. 18.
Figure 24:
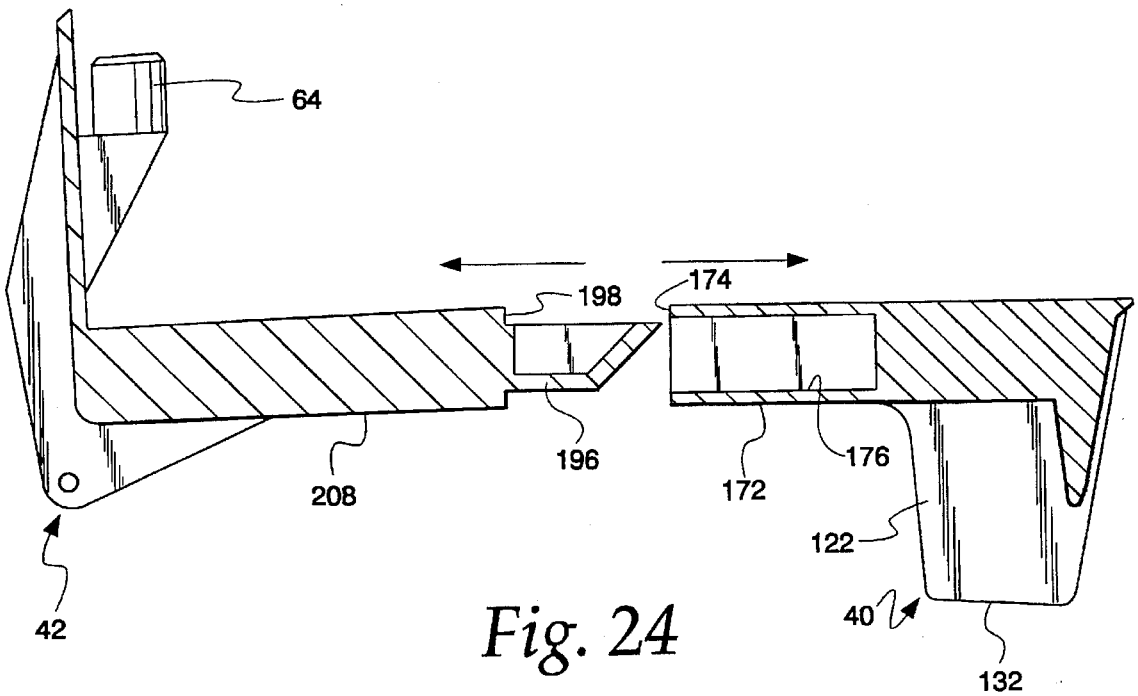
FIG. 24 is a cross-sectional view taken along the line 24—24 of FIG. 19.

The alignment between surfaces 176, 208 is also apparent in FIG. 23, which shows guide finger 196 fully mated within pocket 176. FIG. 24 shows the guide finger and pocket slightly separated. As can be seen in FIGS. 23 and 24, the guide fingers 196 have a beveled leading edge, which helps initial alignment when the closure members 40, 42 are brought together.

Figure 22:
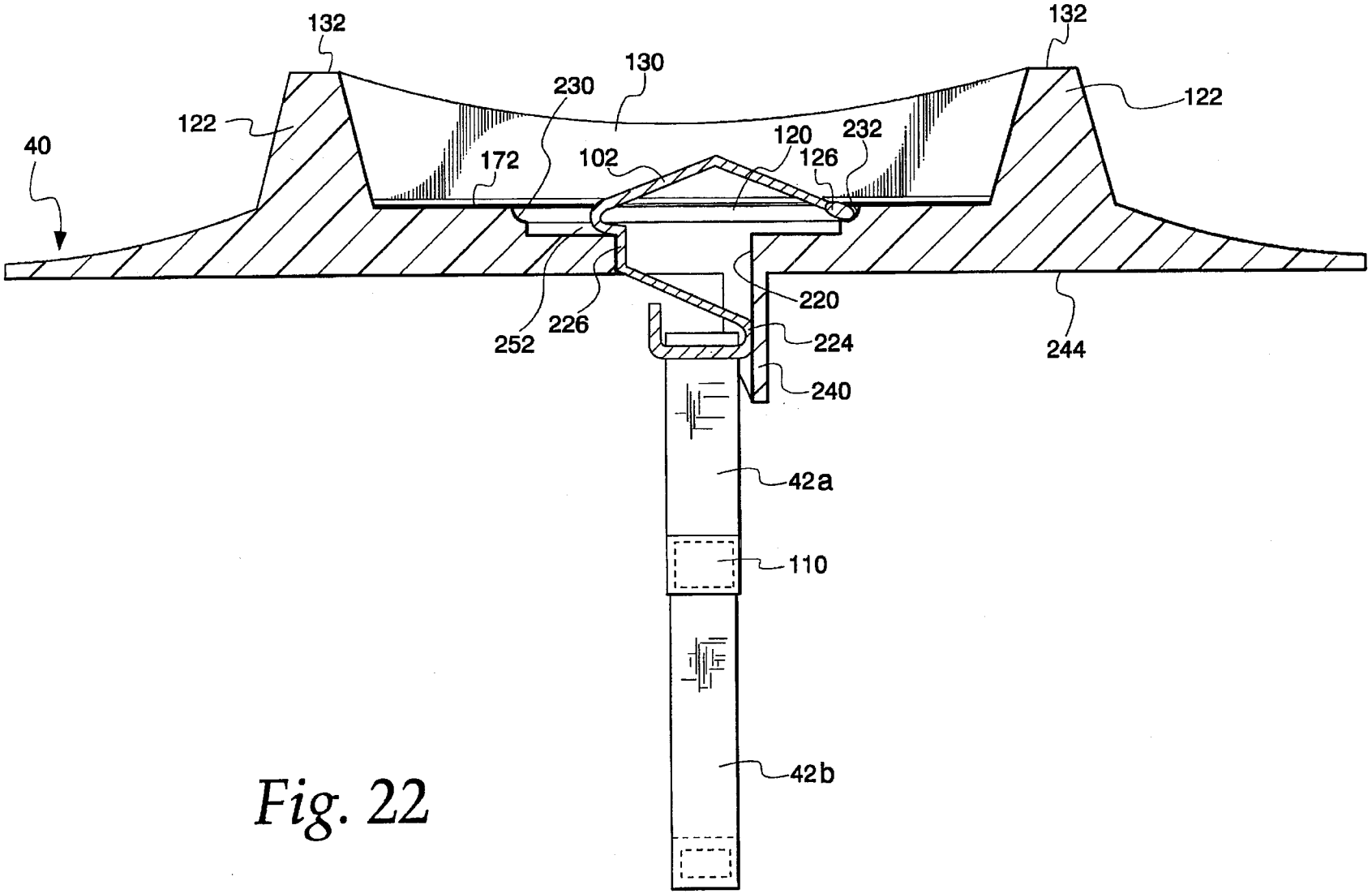
FIG. 22 is a cross-sectional view taken along the line 22—22 of FIG. 18.
Figure 26:
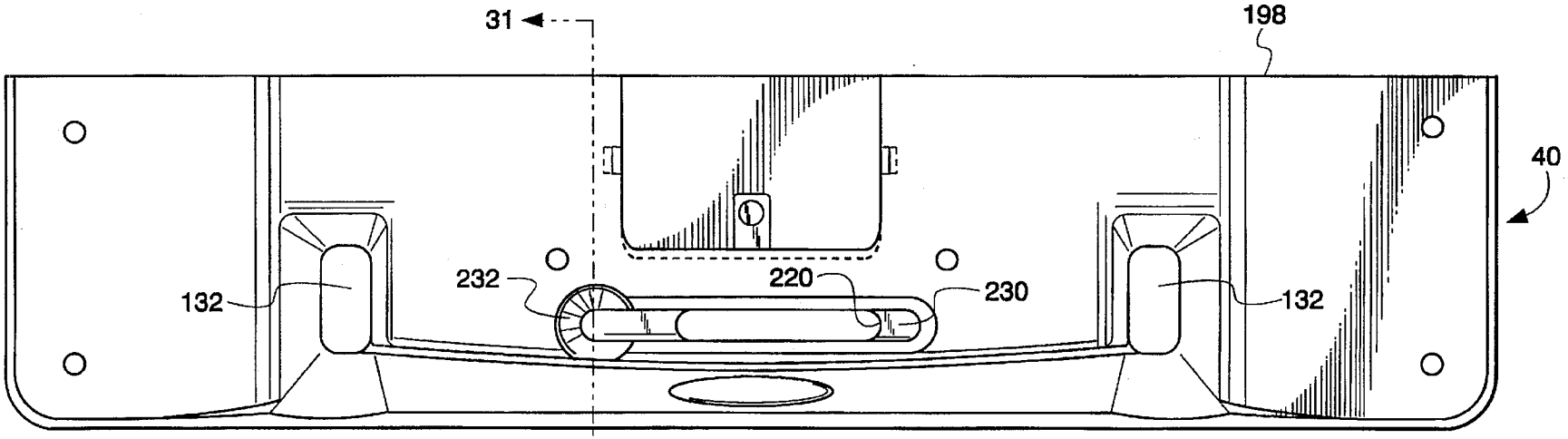
FIG. 26 is a top plan view of the closure member of FIG. 25.
Figure 27:
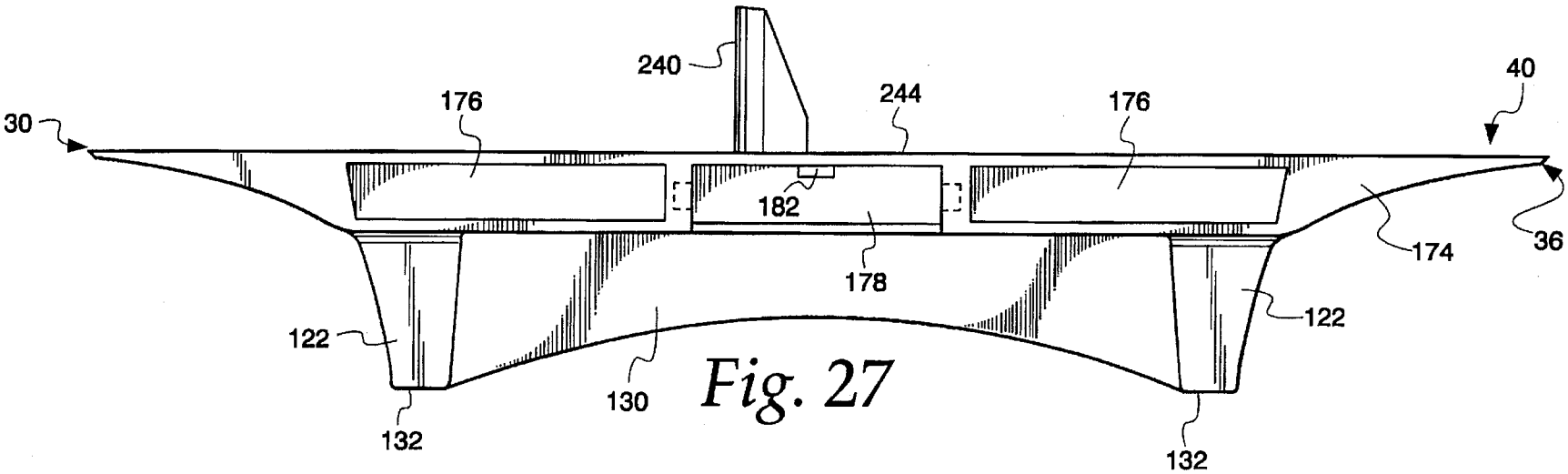
FIG. 27 is an elevational view of the closure member of FIGS. 25 and 26.
Figure 28:
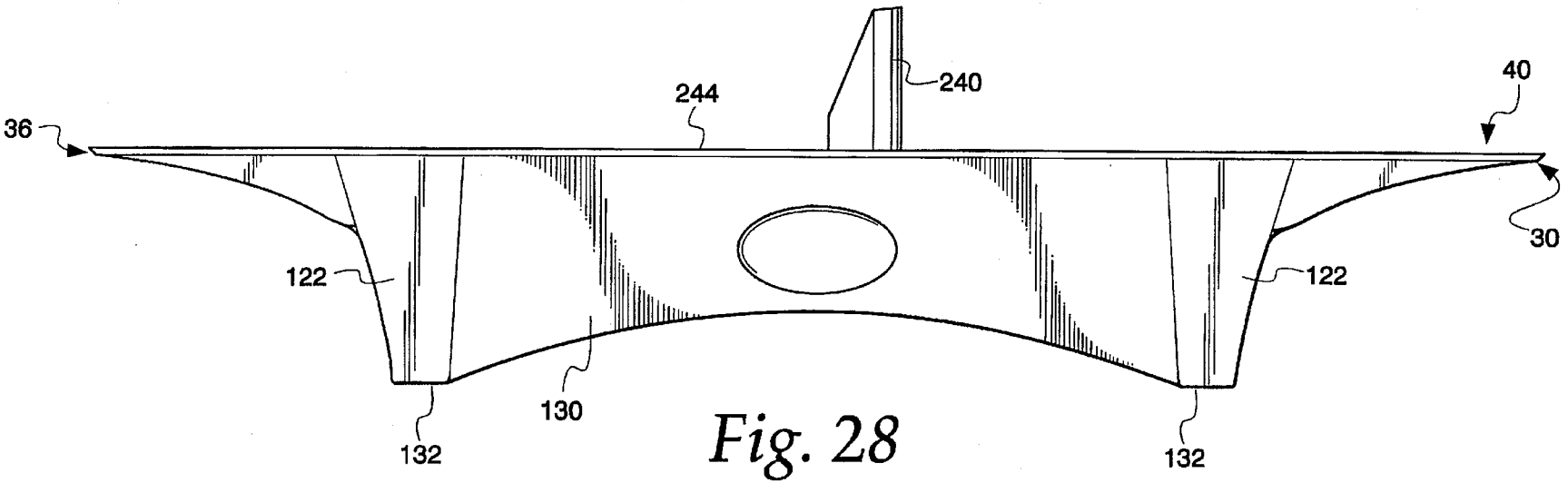
FIG. 28 is an elevational view taken from the opposite side of the closure member as that shown in FIG. 27.
Figure 29:
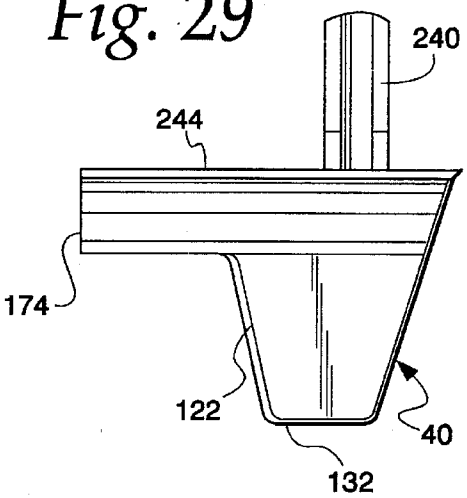
FIGS. 29 and 30 are opposite end views of the closure member shown in FIG. 25.
Figure 36:
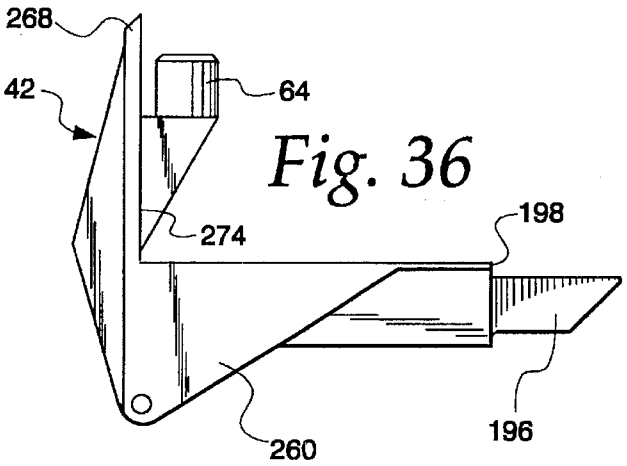
FIG. 36 is an end elevational view of the closure member of FIGS. 32—35.
Figure 37:
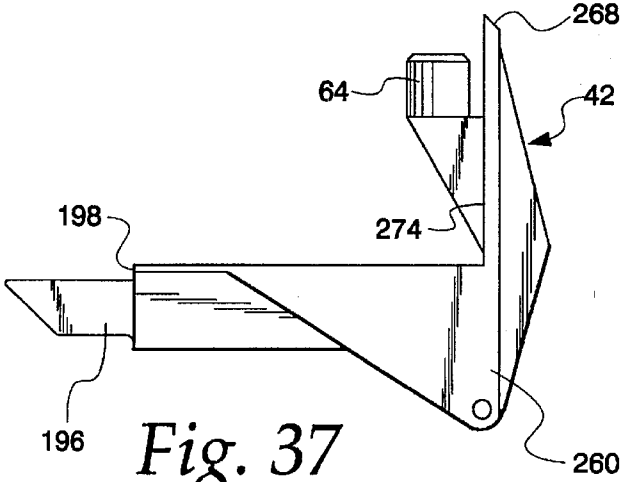
FIG. 37 is an opposing end view of the closure member shown on FIG. 36.
Figure 30:
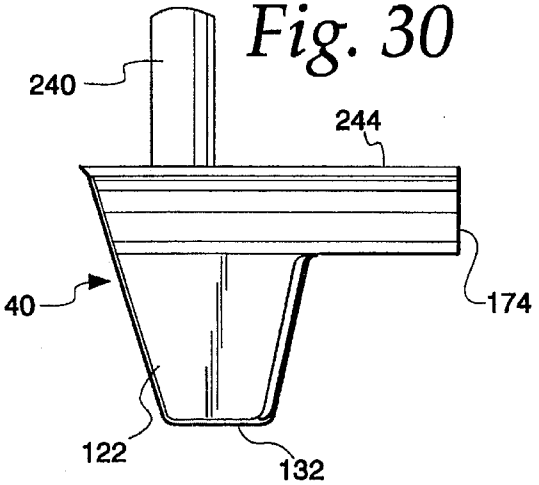
Figure 31:
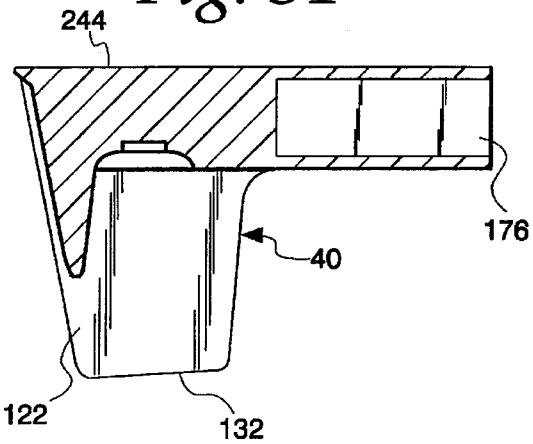
FIG. 31 is a cross-sectional view taken along the line 31—31 of FIG. 26.

Referring to FIG. 22, closure member 40 will be described in greater detail. As can be seen in FIG. 22, aperture 20 includes a series of outwardly diverging steps, opening toward surface 172. Aperture 120 includes a central aperture formed by an elongate slot wall 220 which cams against portions 224, 226 of hook 102 (see, for example, FIGS. 8 and 15) as hook 102 is retracted within closure member 40. A concave recess 230 has an enlarged end portion 232, as shown in FIG. 26. The free end 126 is received in the enlarged recess 232, as shown for example in FIG. 22.

Figure 25:
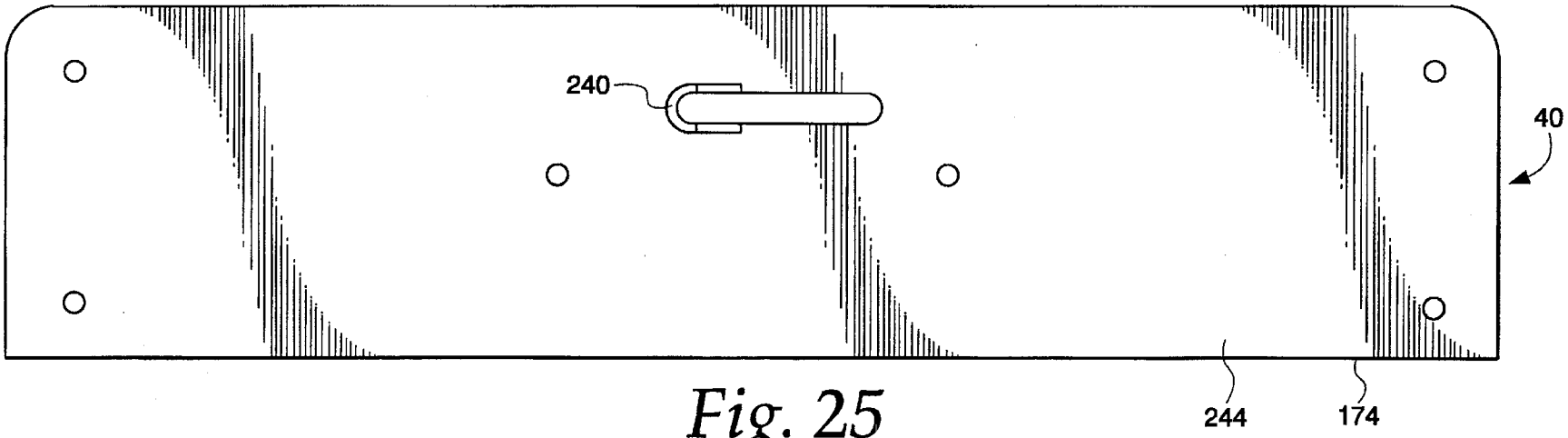
FIG. 25 is a bottom plan view of one closure member.

As hook 102 is retracted within closure member 40, end portion 224 first contacts slot wall 220. An extension wall 240 extends from the major body portion of closure member 40, as illustrated for example in FIG. 22. Extension wall 240 forms a trough-shaped recess having a generally U-shaped cross-sectional configuration, as can be seen for example in the inside, top plan view of FIG. 25. Closure member 40 has an upper, interior surface 244 located opposite surface 172, and facing toward the interior of the garment bag. As hook 102 is received within closure member 40, hook portion 224 is guided within extension wall 240 to aid in aligning hook 102 for its desired seated configuration, shown in FIG. 22, for example. In the final stages of seating, hook portion 226 cams against slot wall 220. Hook portion 124 comes to rest against recessed seat 252 and hook tip 126 comes to rest within the enlarged recess 232.

Figure 33:
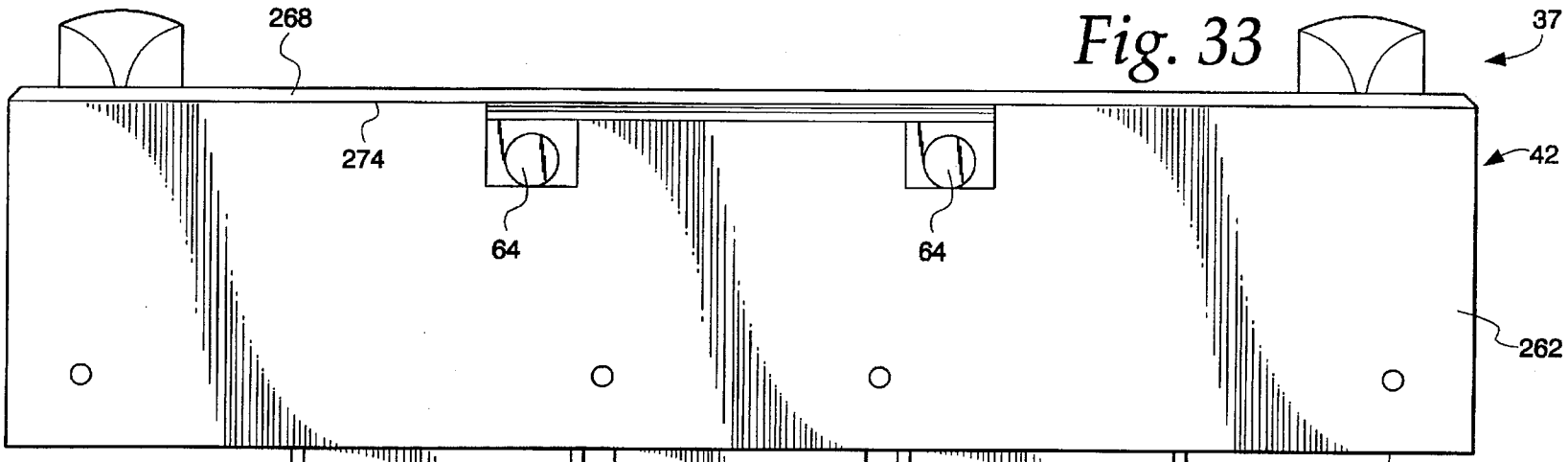
FIG. 33 is a top plan view of the closure member of FIG. 25.
Figure 32:
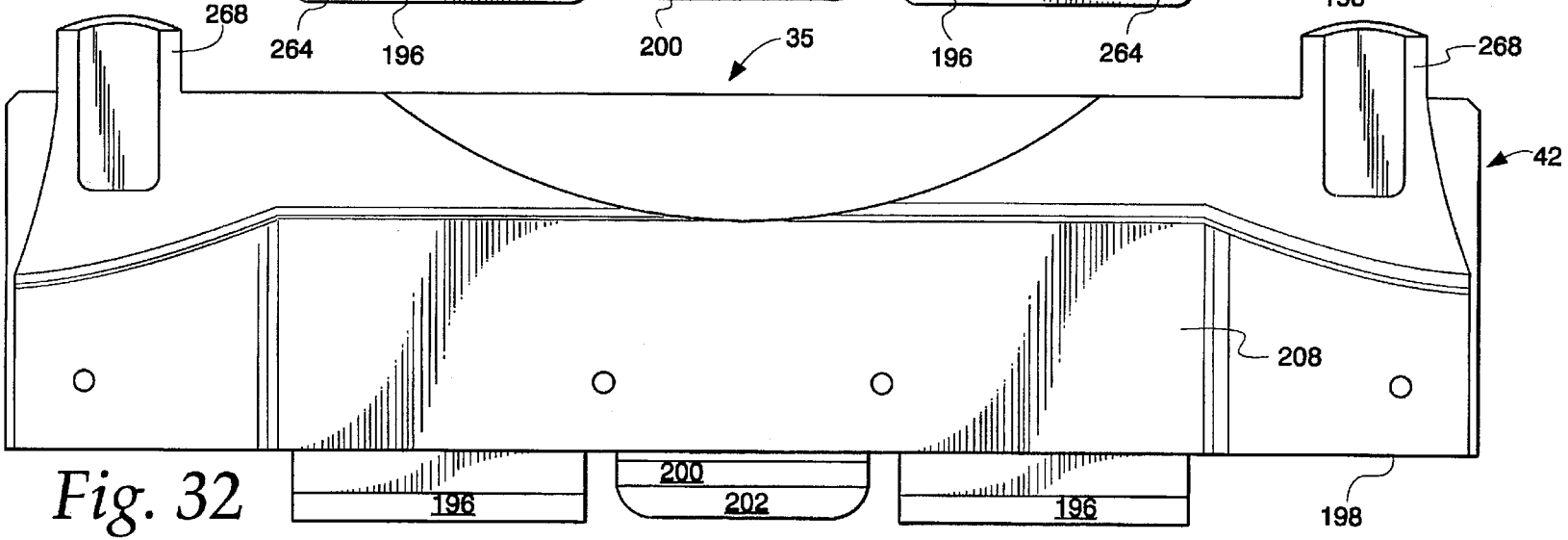
FIG. 32 is a bottom plan view of the closure member shown in FIG. 25.
Figure 34:
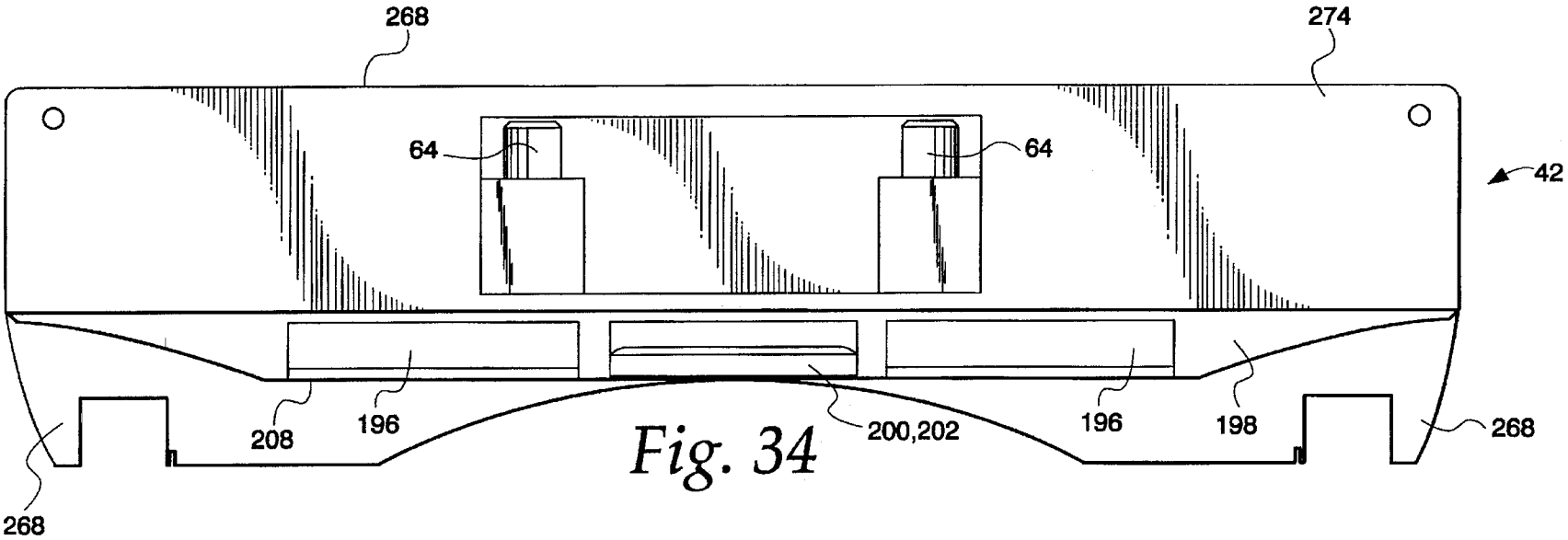
FIG. 34 is a side elevational view of the closure member shown in FIG. 33.
Figure 35:
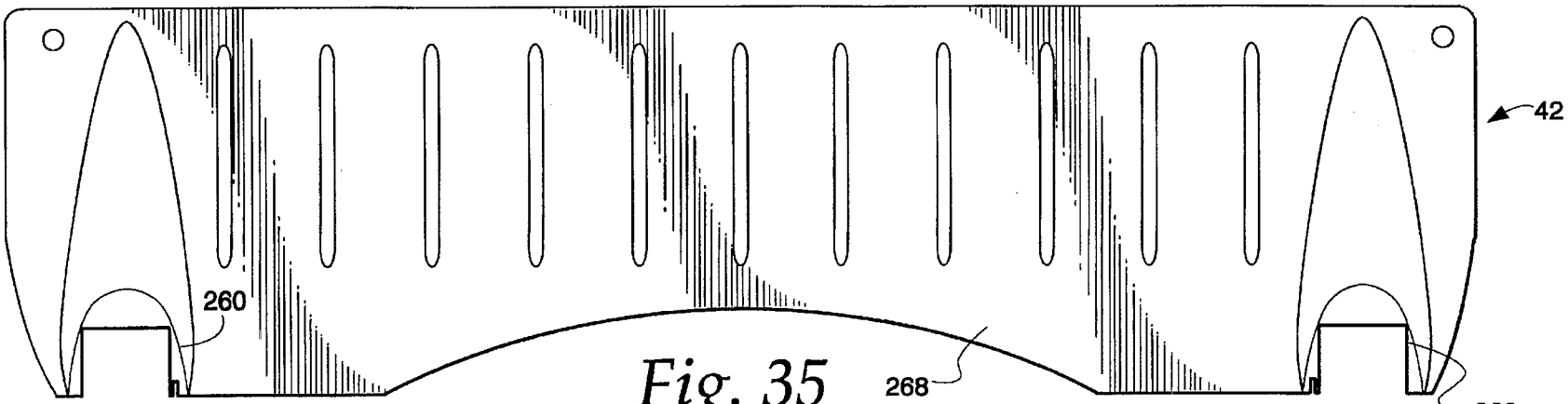
FIG. 35 is a side elevational view of the closure member of FIG. 33, taken from an opposite side.
Figure 38:
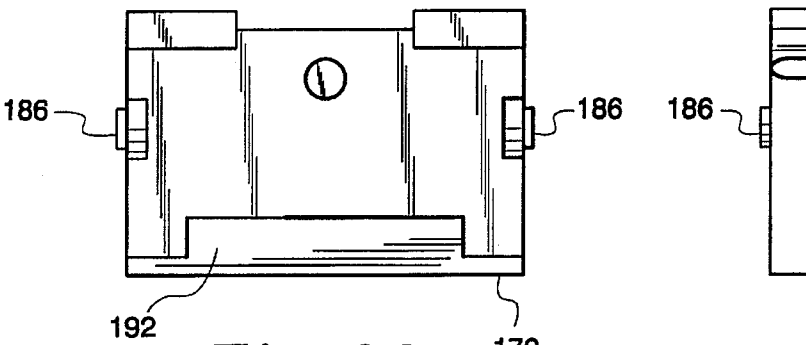
FIG. 38 is a bottom plan view of an actuator button.
Figure 39:
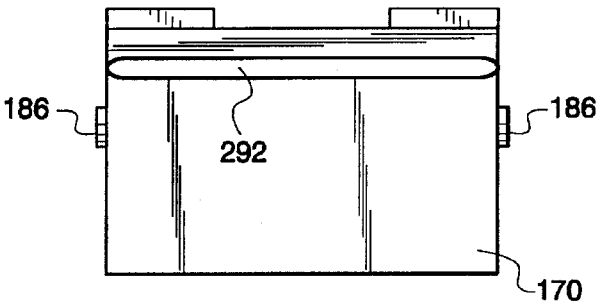
FIG. 39 is a top plan view of the actuator button.
Figure 41:
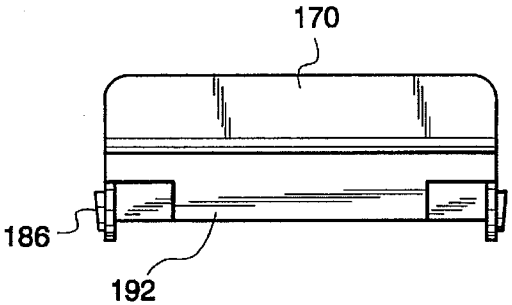
FIG. 41 is an opposing elevational view of the actuator button.
Figure 40:
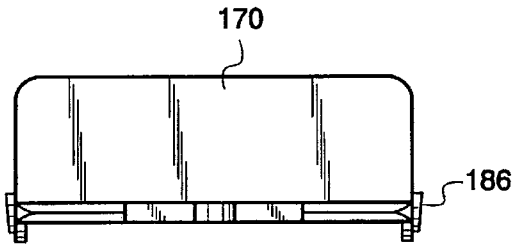
FIG. 40 is an elevational view of the actuator button.
Figure 42:
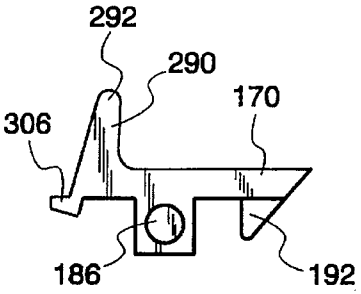
FIG. 42 is an end view of the actuator button.
Figure 43:
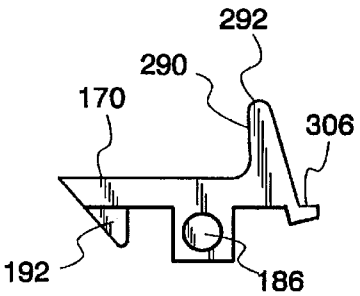
FIG. 43 is an end view of the actuator button, taken from an opposite direction of that shown in FIG. 42.

Referring now to FIGS. 32–37, closure member 42 includes a bottom or downwardly facing exterior surface 208, as mentioned above. Closure member 42 further includes wheel wells 260 for receiving wheels 46, as illustrated for example in FIG. 13. Referring to the top plan view of FIG. 33, closure member 42 further includes an inside surface 262, lying opposite bottom surface 208. As can be seen in FIG. 33, the alignment fingers 196 are preferably formed with concave recesses 264, which open towards the interior of bag 10. Closure member 42 further includes a sidewall 268. As can be seen in FIGS. 33 and 34, for example, connection pins 64 are mounted to an inside surface 274 of walls 268.

Figure 18:
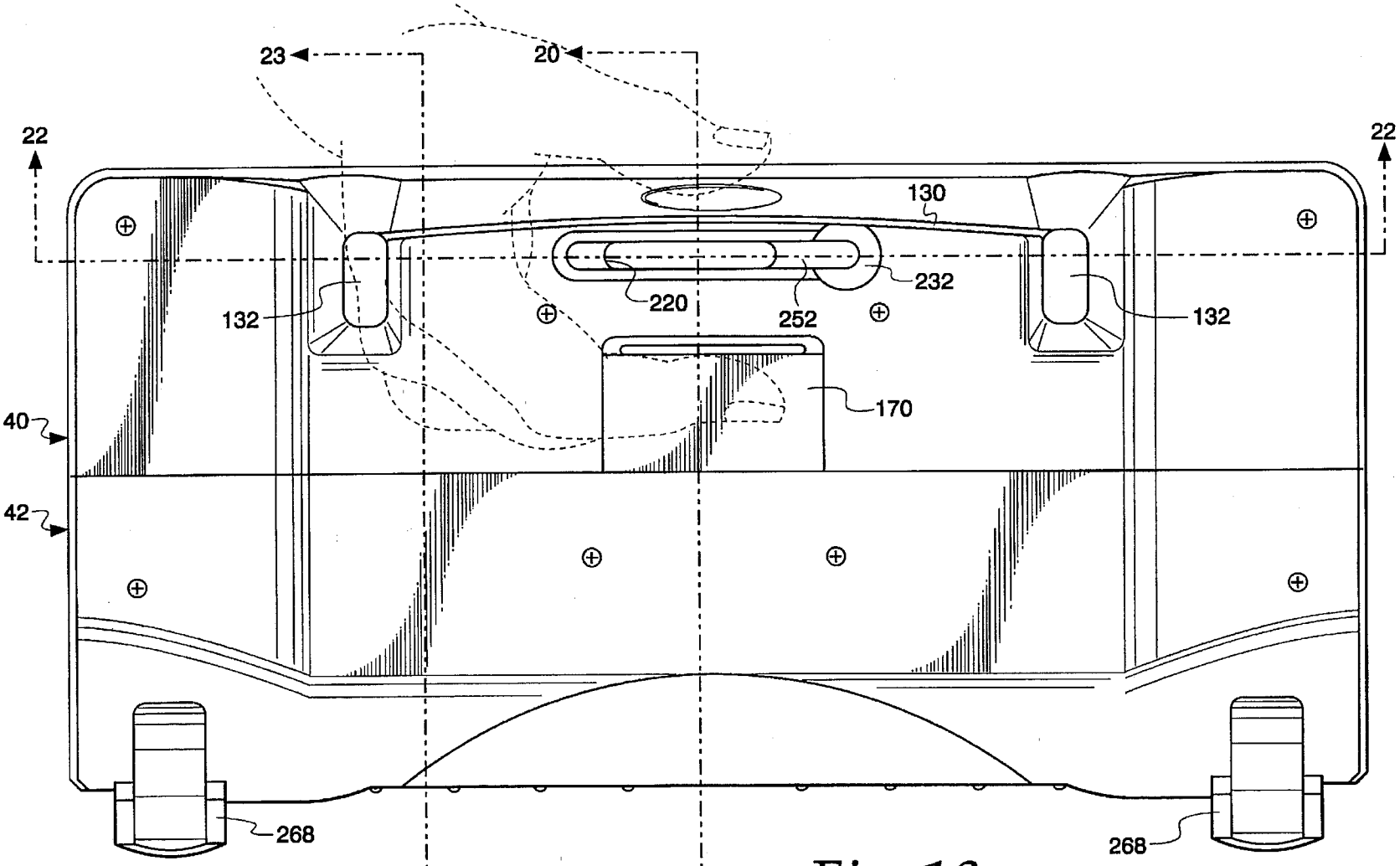
FIG. 18 is a bottom plan view showing the closure members in a closed position.

Turning now to FIGS. 38–42, button 170 includes an upstanding wall 290 having a free edge 292 for manual engagement, as indicated for example in FIG. 18. As mentioned above, button 170 is mounted for pivoting movement by mounting pins 186 received in pockets 300 from adjacent recess 178, as can be seen for example in FIG. 17. Referring to FIG. 17, recess 178 includes an outwardly protruding ridge 304 at its rearward end. Button 170 includes a ledge 306 which contacts ridge 304, providing a top action for controlling the force of spring 184.

As described above, the guiding recesses 176 and latching recess 178 are all formed in the top closure member 40, whereas a complementary guide fingers 196 and latching tip 192 are carried on the bottom closure member. However, this arrangement could be reversed with guide fingers and latching tip provided on the top closure member, and with recesses formed in the bottom closure member. Further, the recesses and guide fingers and latching member could be interspersed within the same closure member and this may offer advantages in certain situations. Further, as described above, the guide wall 130 is provided to shield the manually graspable upper portion of button 170 to prevent accidental contact which may result in inadvertent unlatching of the bag half portions.

A shielding wall which is also useful to develop finger pressure to operate a spring-loaded latching feature. However, if desired, the guide wall could be omitted. In its preferred form, the button 170, described above, is relatively, easily moved between latched and unlatched positions and accordingly, it has been found desirable to not only provide a shielding wall, adjacent the button, but also to locate the latching features of the button interiorly within the molded plate portion of top closure member 40. However, if desired, the knob 170 could be arranged exterior of the molded plate, engaging a cooperating, latching projection formed on top of the molded plate of the bottom closure member 42. In this latter arrangement, an increase in spring force or other type of increased difficulty in operating latching members would be preferred.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A hand-carried baggage article, comprising:

a flexible, vertically elongated bag defining an enclosed interior and having opposed top and bottom ends, and foldable about a midsection which is located between the top and bottom ends so as to form two at least partly overlying half portions;

a top plate attached to the top end of the bag and defining an aperture communicating with the bag interior;

a hook means for hanging support of the bag;

a flexible elongated connecting member having a first, free end and a second end, the first end connected to the hook means and the second end coupled to a portion of the bag located remote from the bag top end;

biasing means for resiliently biasing at least the first end of the connecting member toward the second end of the connecting member; and the connecting member extending through the top plate aperture and cooperating with the biasing means to allow the hook means to move between extended and retracted positions with at least a portion of the hook means extending beyond the top plate when the hook means is in an extended position, and with the hook means seated against the top plate when the hook means is in the retracted position.

2. The article of claim 1 wherein the top plate defines a recess surrounding the aperture for receiving the hook means so that, when the connecting member is retracted, the hook means is substantially entirely received within the top plate.

3. The article of claim 1 wherein the biasing means comprises resilient material extending along a substantial portion of the connecting member.

4. The article of claim 1 wherein the bag has first and second opposed major walls extending between top and bottom ends, with the second major wall being selectably openable for access to the bag interior, the connecting member attached to the first major wall.

5. The article of claim 1 further comprising a bottom plate attached to the bottom end of the bag.

6. The article of claim 5 wherein the bottom plate includes means for mounting wheels outside of the bag for rolling transport of the article.

7. The article of claim 6 further comprising a frame within the bag and cooperating with the bottom plate so as to form a cart supporting the bag during transport.

8. The article of claim 7 wherein the cart is mounted to the first major wall, adjacent the second end of the bag and below the hook means.

9. The article of claim 5 wherein the top and bottom plates include means for releasably joining together when the bag is folded to overlie one half portion with the other.

10. The article of claim 9 wherein the top and bottom plates have major exterior surfaces which are coplanar aligned with one another when the top and bottom plates are joined together.

11. An improved hand-carried baggage article, comprising:

a flexible, vertically elongated bag defining an enclosed interior and having opposed first and second ends, and foldable about a midsection which is located between the first and second ends so as to form two at least partly overlying bag portions;

a first plate attached to the first end of the bag and defining an aperture communicating with the bag interior;

a hook means for hanging support of the bag;

flexible, resilient coupling means for coupling the hook means to the bag, having a first, free end and a second end, the first end connected to the hook means and the second end coupled to a bag portion of the bag located remote from the bag first end, the resilient coupling means extending through the first plate aperture so as to allow the hook means to move between extended and retracted positions with at least a bag portion of the hook means extending beyond the first plate when the hook means is in an extended position, and with the hook means seated against the first plate when the hook means is in the retracted position.

12. The article of claim 11 wherein the resilient coupling means comprises an elongated web of elastic material.

13. The article of claim 12 further comprising connecting means of substantially inelastic material for connecting the web of elastic material to the bag.

14. The article of claim 11 wherein the second end of the resilient coupling means is directly connected to the bag.

15. The article of claim 11 further comprising a bottom plate attached to the bottom end of the bag.

16. The article of claim 15 wherein the bottom plate includes means for mounting wheels outside of the bag for rolling transport of the article.

17. The article of claim 16 further comprising a frame within the bag and cooperating with the bottom plate so as to form a cart supporting the bag during transport.

18. The article of claim 17 wherein the bag has first and second opposed major walls extending between first and second ends and wherein the cart is mounted to the first major wall, adjacent the second end of the bag and below the hook means.

19. A hand-carried baggage article, comprising:

a flexible, vertically elongated bag defining an enclosed interior and having opposed first and second ends, and foldable about a midsection which is located between the first and second ends so as to form two at least partly overlying bag portions;

a first plate attached to the first end of the bag and defining an aperture communicating with the bag interior;

a hook means for hanging support of the bag;

a flexible elongated connecting member having a first, free end and a second end, the first end connected to the hook means and the second end coupled to a bag portion of the bag located remote from the bag first end;

biasing means for resiliently biasing at least the first end of the connecting member toward the second end of the connecting member;

the connecting member extending through the first plate aperture and cooperating with the biasing means to allow the hook means to move between extended and retracted positions with at least a bag portion of the hook means extending beyond the first plate when the hook means is in an extended position, and with the hook means seated against the first plate when the hook means is in the retracted position; and the first plate including a guide wall defining a trough-shaped recess for guiding the connecting member as the hook means is moved between extended and retracted positions.

20. The article of claim 19 wherein the hook means includes an upper free end with a tip and the top plate exterior surface defines a recess adjacent the aperture for receiving the hook tip when the hook means is in the retracted position.

21. The article of claim 20 wherein the hook means further includes a bottom end with a guide portion receivable in the trough-shaped recess of the guide wall so as to align the hook means with respect to the top plate.

22. The article of claim 21 wherein the hook means further includes a mid portion between the top and bottom ends including an other guide portion for contacting another end of the aperture so as to provide additional alignment of the hook means with respect to the top plate.

23. The article of claim 22 wherein the hook means mid portion further includes a step portion for seating against the top plate when the hook means is in the retracted position.

24. A hand-carried baggage article, comprising:

a flexible, vertically elongated bag defining an enclosed interior and having opposed first and second ends, and foldable about a midsection which is located between the first and second ends so as to form two at least partly overlying bag portions;

a first plate attached to the first end of the bag, having a mating edge and defining an aperture communicating with the bag interior;

a second plate attached to the second end of the bag and having a mating edge; and releasable joinder means for releasably joining the mating edges of the first and second plates together when the bag is folded to overlie one bag portion with the other, including a latching recess extending from the mating edge of one of said first and said second plates, a latching finger extending from the other of said first and said second plates and dimensioned to be received in the latching recess, and a latch means carried on said one of said first and said second plates, adjacent the latching recess, for releasably engaging the finger;

a guiding recess extending from the mating edge of one of said first and said second plates, and a guiding finger extending from the other of said first and said second plates and dimensioned to be received in the guiding recess;

a hook means for hanging support of the bag;

a flexible elongated connecting member having a first, free end and a second end, the first end connected to the hook means and the second end coupled to a bag portion of the bag located remote from the bag first end;

biasing means for resiliently biasing at least the first end of the connecting member toward the second end of the connecting member;

the first plate defining an aperture communicating with the bag interior; and the connecting member extending through the aperture and cooperating with the biasing means to allow the hook means to move between extended and retracted positions with at least a bag portion of the hook means extending beyond the first plate when the hook means is in an extended position, and with the hook means seated against the first plate when the hook means is in the retracted position.

25. The article of claim 4 wherein the latch means comprises a latch member pivotally mounted to said first plate for movement between latched and unlatched positions engaged and disengaged from said latching finger, respectively.

* * * * *